US010700474B2

(12) United States Patent
Chen

(10) Patent No.: US 10,700,474 B2
(45) Date of Patent: Jun. 30, 2020

(54) PLUG CONNECTOR HAVING UNLOCKING FUNCTION

(71) Applicant: OUPIIN ELECTRONIC (KUNSHAN) CO., LTD., Jiangsu province (CN)

(72) Inventor: Hsin Chih Chen, Jiangsu province (CN)

(73) Assignee: OUPIIN ELECTRONIC (KUNSHAN) CO., LTD., Jiangsu Province (CN)

( * ) Notice: Subject to any disclaimer, the term of this patent is extended or adjusted under 35 U.S.C. 154(b) by 0 days.

(21) Appl. No.: 16/540,103

(22) Filed: Aug. 14, 2019

(65) Prior Publication Data

US 2020/0059042 A1 Feb. 20, 2020

(30) Foreign Application Priority Data

Aug. 14, 2018 (CN) ..... 201810923548
Aug. 14, 2018 (CN) ..... 201821307016

(51) Int. Cl.

| | |
|---|---|
| ***H01R 13/633*** | (2006.01) |
| ***H01R 13/627*** | (2006.01) |
| ***H01R 13/502*** | (2006.01) |
| *H01R 107/00* | (2006.01) |
| *H01R 24/62* | (2011.01) |

(52) U.S. Cl.

CPC ..... *H01R 13/6335* (2013.01); *H01R 13/502* (2013.01); *H01R 13/6275* (2013.01); *H01R 24/62* (2013.01); *H01R 2107/00* (2013.01)

(58) Field of Classification Search

CPC ..... H01R 13/6335; H01R 13/502; H01R 13/6275; H01R 24/62; H01R 2107/00

See application file for complete search history.

(56) References Cited

U.S. PATENT DOCUMENTS

| | | | | |
|---|---|---|---|---|
| 7,934,959 | B2 * | 5/2011 | Rephaeli | G02B 6/4201 439/620.22 |
| 10,044,140 | B1 * | 8/2018 | Gianrossi | H05K 7/1498 |
| 2014/0315420 | A1 * | 10/2014 | Sticker | H01R 13/64 439/374 |
| 2014/0364001 | A1 * | 12/2014 | Kraus | H01R 13/6272 439/358 |
| 2020/0059042 | A1 * | 2/2020 | Chen | H01R 13/6335 |

* cited by examiner

*Primary Examiner* — Abdullah A Riyami
*Assistant Examiner* — Nader J Alhawamdeh
(74) *Attorney, Agent, or Firm* — Mark M. Friedman

(57) ABSTRACT

A plug connector having unlocking function is disclosed in the present invention. The plug connector includes a base, a signal transmission module, a lock head, a cover and an unlocking device. The lock head has two symmetrical edge protrusions, each of which has an upward inclined surface. The unlocking device includes a sliding member being slidably mounted on the cover and being connected with the lock head, and a pull strip being connected with the sliding member. A connection mouth of the sliding member has two downward inclined surfaces. A free end of the lock head is embedded into the connection mouth, and the upward inclined surface is pressed against the corresponding downward inclined surface. When pulling the pull strip backward, the sliding member moves backward, and the downward inclined surface can push the edge protrusion to move downward and drive the lock head to go down for unlocking.

10 Claims, 19 Drawing Sheets

PLUG CONNECTOR HAVING UNLOCKING FUNCTION

BACKGROUND OF THE INVENTION

1. Field of the Invention

The present invention relates to a connector technology, and more particularly to a plug connector having unlocking function.

2. Description of the Prior Art

Locking devices are usually disposed on a plug connector and a socket connector, which can be engaged together, to prevent them from loosening due to external forces after docking, thereby ensuring the reliability and safety of mechanical connection between them.

A common locking way is to set a lock head on the plug connector.

Please refer to FIG. 1, an RJ45 plug 9 for computer networks disposes an elastic lock arm 90. When the RJ45 plug 9 is inserted into an RJ45 socket 8, first the elastic lock arm 90 is pressed downward, then the plug 9 enters into the socket 8, and the elastic lock arm 90 is engaged with a block 80 in the socket 8, thereby locking the plug 9 and the socket 8 together. When needing to unlock them, first the elastic lock arm 90 is pressed downward again, and is detached from the block 80, thereby unlocking the plug 9 and the socket 8.

However, when unlocking, because of the difficulty in pressing the elastic lock arm 90, it is even necessary to use an auxiliary tool for pressing the elastic lock arm 90 in place. So the existing unlocking operation is difficult.

Hence, it is necessary to provide a new plug connector that adopts a new unlocking way to solve the problem existing in the prior art.

BRIEF SUMMARY OF THE INVENTION

A primary object of the present invention is to provide a plug connector having unlocking function, which employs a sliding member and a lock head combined together to complete an unlocking work by pulling a pull strip backward, so the locking and unlocking way of the present invention is safe, effective and convenient.

Other objects and advantages of the present invention may be further understood from the technical features disclosed by the present invention.

To achieve the aforementioned object or other objects of the present invention, the present invention adopts the following technical solution.

The present invention provides a plug connector having unlocking function, comprising a base, a signal transmission module being mounted in the base, a lock head being disposed on the base, a cover being mounted on the base, and an unlocking device. The lock head has a fixed end fixed on the base, a free end located above the base and extending backward, and two shoulders formed between the fixed end and the free end. The two shoulders are located above the base and can be locked in a socket connector. Wherein the free end forms two symmetrical edge protrusions, each of which has an upward inclined surface. The cover has a horizontal top wall and two symmetrical sidewalls perpendicular to the top wall. Wherein the cover forms two sliding grooves, each of which has a cut. The unlocking device includes a sliding member and a pull strip. The sliding member is slidably mounted on the cover and is connected with the lock head. And the pull strip is connected with the sliding member. Wherein the sliding member has a main body, two sliding ribs separately formed on two sides of the main body, a connection mouth formed on a front of the main body, and an elastic arm formed on a rear of the main body. Each sliding rib has a hook protruding outward on a rear of the sliding rib. The connection mouth has two downward inclined surfaces, which can be engaged with the corresponding upward inclined surfaces of the edge protrusions. Wherein the sliding rib enters into the corresponding sliding groove, the hook enters into the corresponding cut, the elastic arm is pressed against the top wall of the cover, the free end of the lock head is embedded into the connection mouth, and the upward inclined surface of the edge protrusion is pressed against the corresponding downward inclined surface. When pulling the pull strip backward, the sliding member can move backward, the elastic arm can be compressed, the downward inclined surface can push the corresponding edge protrusion to move downward and further drive the lock head to go down for unlocking. When releasing the pull strip, the sliding member can automatically move forward with the help of the elastic arm, and the lock head can go up to return to its initial state.

In one embodiment, the top wall of the cover has an opening formed on a front end thereof, the two sliding grooves are formed on two sides of the opening, and the sliding member is mounted in the opening of the cover.

In one embodiment, the elastic arm consists of two inward curved portions.

In one embodiment, the main body of the sliding member has at least one slit formed on a top of the main body and located on rear of the connection mouth; and the pull strip has at least one claw on a front end of the pull strip, and the claw enters into the slit.

In one embodiment, the top wall of the cover has a limiting bar located on a middle of the top wall, two front limiting grooves near a front end of the top wall, and two rear limiting grooves near a rear end of the top wall. The pull strip has a middle groove in a middle of the pull strip, a pair of front side wings near the front end of the pull strip, and a pair of rear side wings near a rear end of the pull strip. Wherein the front side wings enter into the corresponding front limiting grooves, the rear side wings enter into the corresponding rear limiting grooves, and the limiting bar is protruding out of the middle groove.

In one embodiment, the pull strip has a pull ring on a rear end of the pull strip.

In one embodiment, the two edge protrusions are symmetrically formed on two sides of the free end; the two shoulders are also symmetrically located on two sides of the free end; and the upward inclined surface is a front surface of the edge protrusion.

In one embodiment, a top contour of the connection mouth is the same as a contour of the free end of the lock head.

In one embodiment, the base has a U-shaped receiving portion, and an inverted U-shaped plug portion communicated with the receiving portion.

In one embodiment, the signal transmission module has a front portion, a rear portion, multiple electrical contact terminals located at the front portion and exposed on a bottom of the front portion, and a cable extending out of the rear portion; wherein the front portion enters into the plug portion; the electrical contact terminals are exposed to the outside from a bottom of the plug portion; the rear portion is placed into the receiving portion; and the cable extends out of the base.

In comparison with the prior art, the plug connector having unlocking function in the present invention employs the pull strip to make the sliding member move backward, and to force the lock head to go down, thereby realizing to unlock. When releasing the pull strip, the lock head can go up with the help of automatic reset of the sliding member, thereby realizing locking. The locking and unlocking way of the present invention is safe, effective and convenient.

DETAILED DESCRIPTION OF THE PREFERRED EMBODIMENTS

Figure 1:
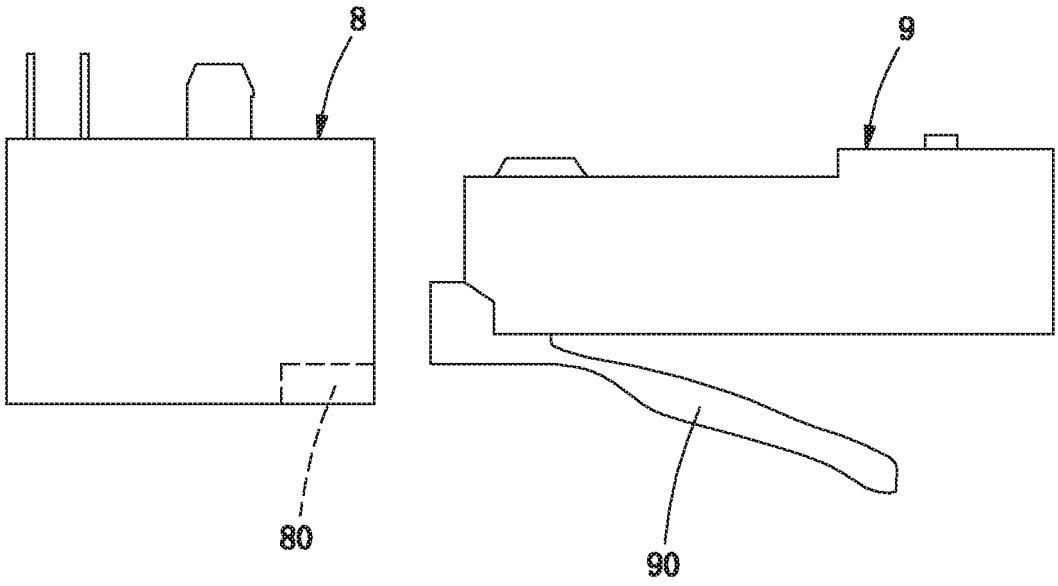
FIG. 1 is a schematic view of an existing plug, which mainly shows a lock head having locking and unlocking functions.

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" "above", "below" etc., are only used with reference to the orientation of the accompanying drawings. Therefore, the used directional terms are intended to illustrate, but not to limit, the present invention.

Please refer to FIGS. 2 to 5, a plug connector 1 of the present invention includes a base 10, a signal transmission module 20 mounted in the base 10, a lock head 30 disposed on the base 10, a cover mounted on the base 10, and an unlocking device 50 mounted on the cover 40.

Figure 4:
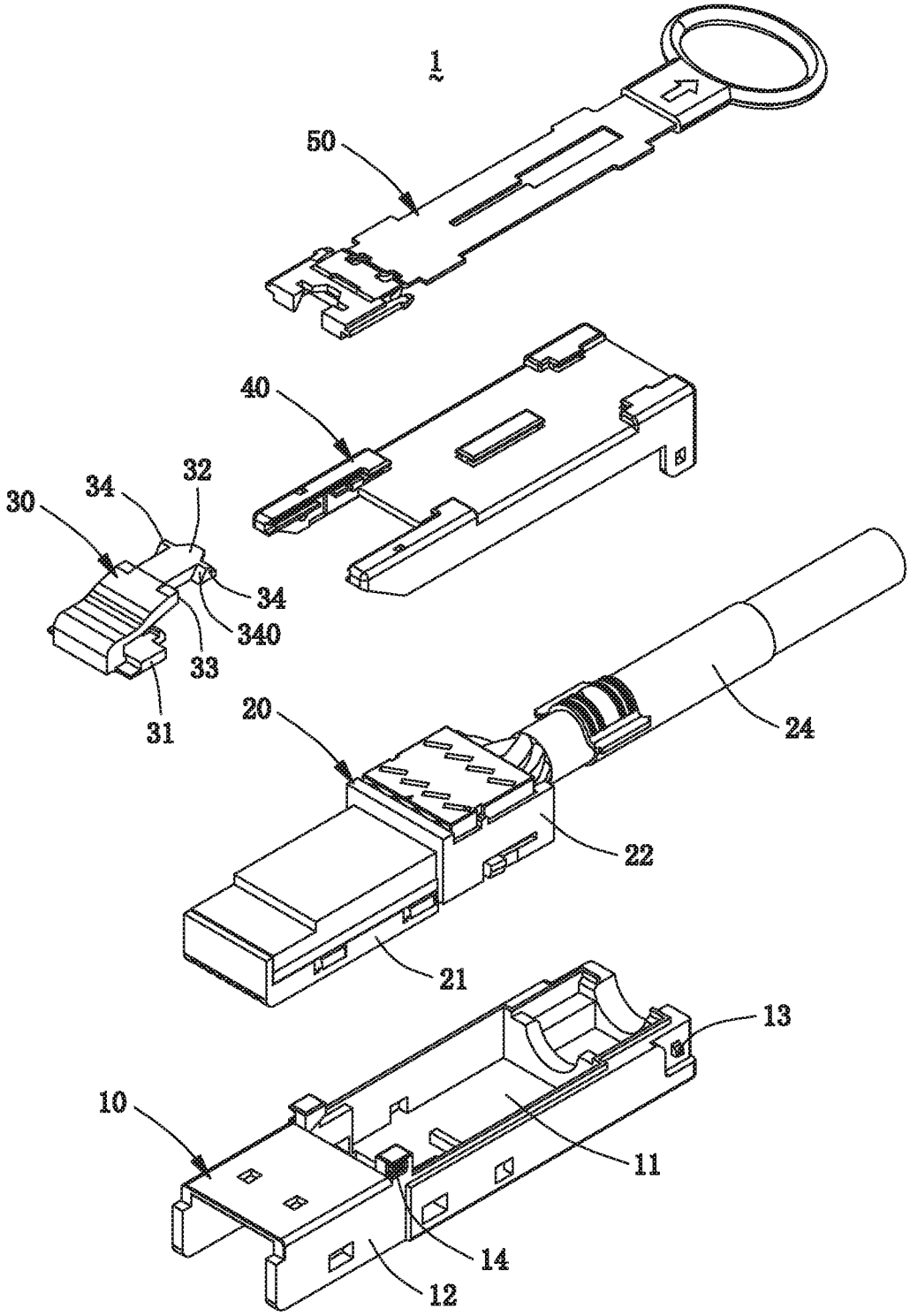
FIG. 4 is an exploded view of the plug connector of the present invention.
Figure 5:
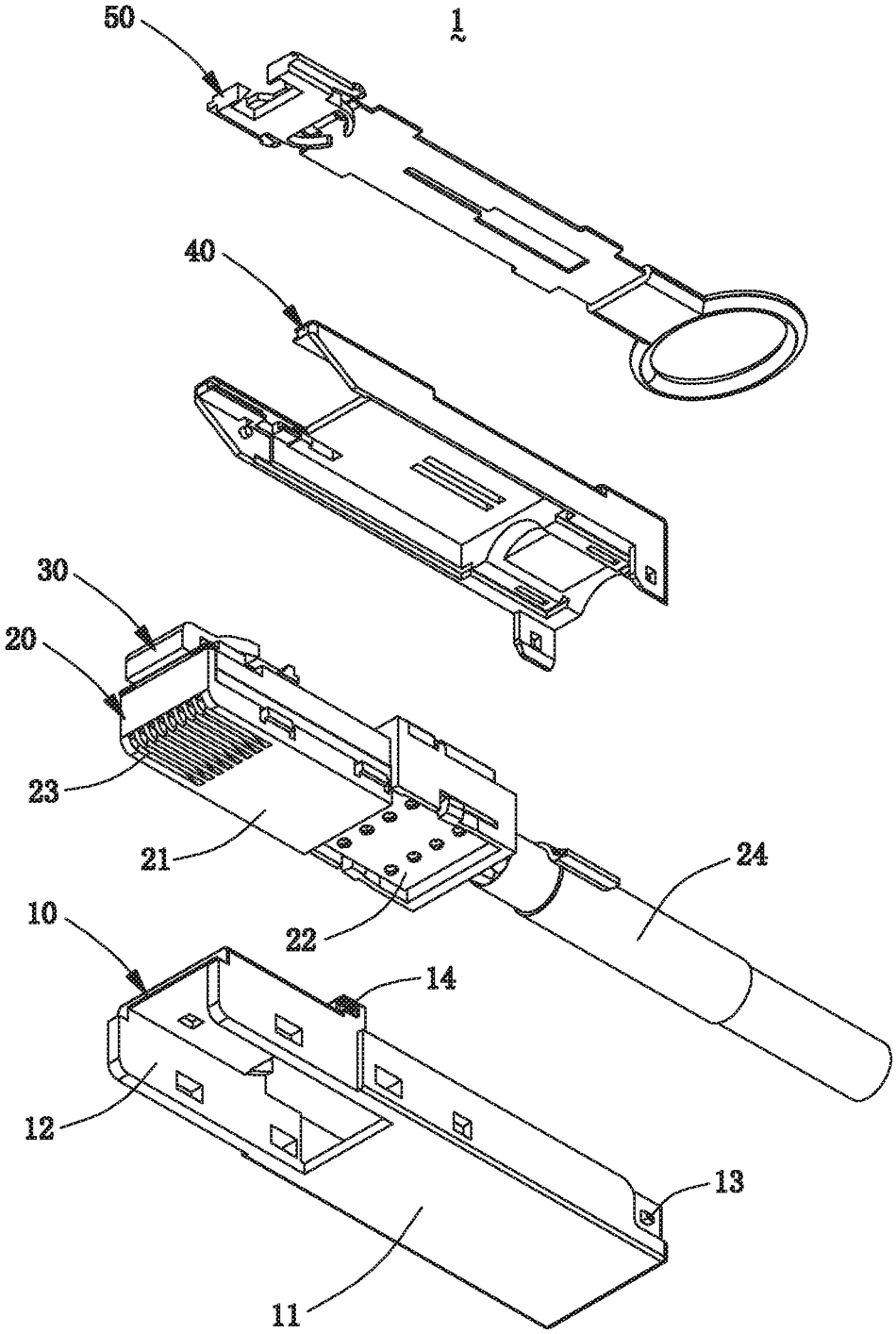
FIG. 5 is an exploded view of the plug connector of the present invention along another direction.

Referring to FIGS. 4 and 5, the base 10 has a U-shaped receiving portion 11, and an inverted U-shaped plug portion 12 communicated with the receiving portion 11. The base 10 further has a bump 13 and an axis hole 14.

It should be noted that the so-called U-shaped and inverted U-shaped are defined with reference to the direction shown in drawings.

Referring to FIGS. 4 and 5, the signal transmission module 20 has a front portion 21, a rear portion 22, multiple electrical contact terminals 23 located at the front portion 21 and exposed on the bottom of the front portion 21, and a cable 24 extending out of the rear portion 22.

Figure 6:
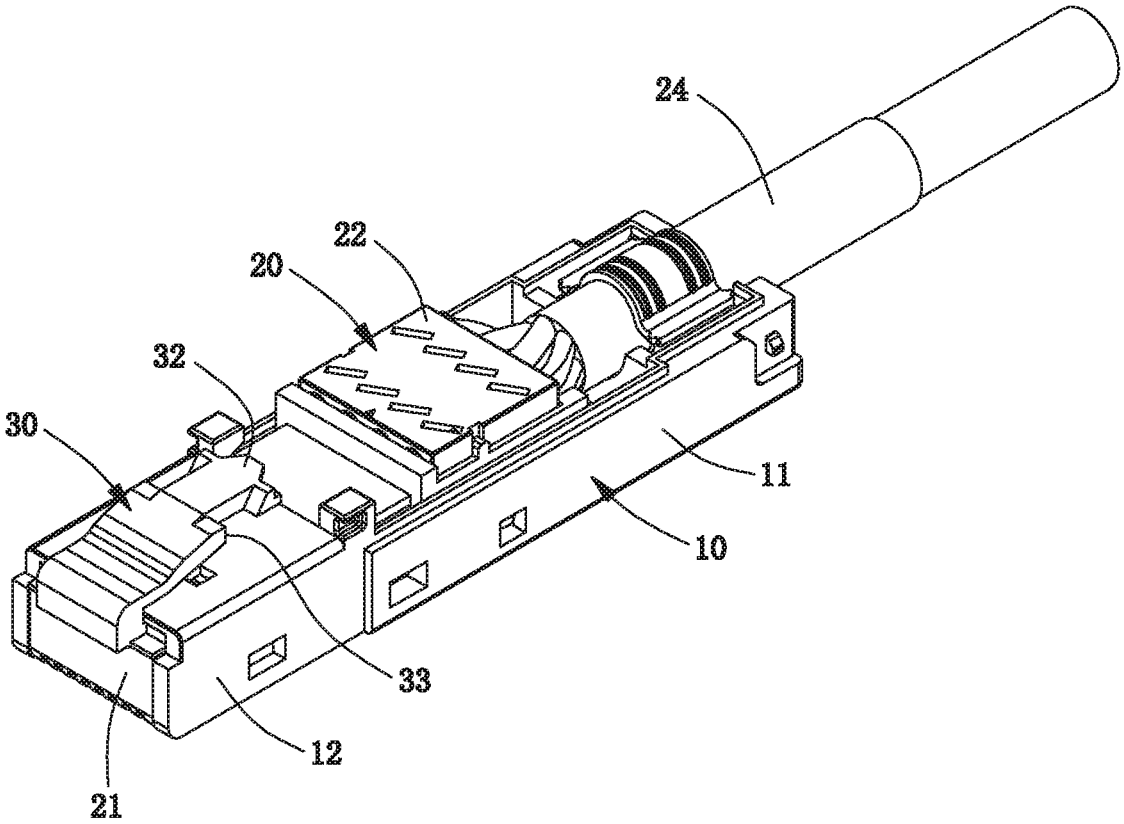
FIG. 6 is a schematic view of a signal transmission module and a base after being combined together in the present invention.
Figure 18:
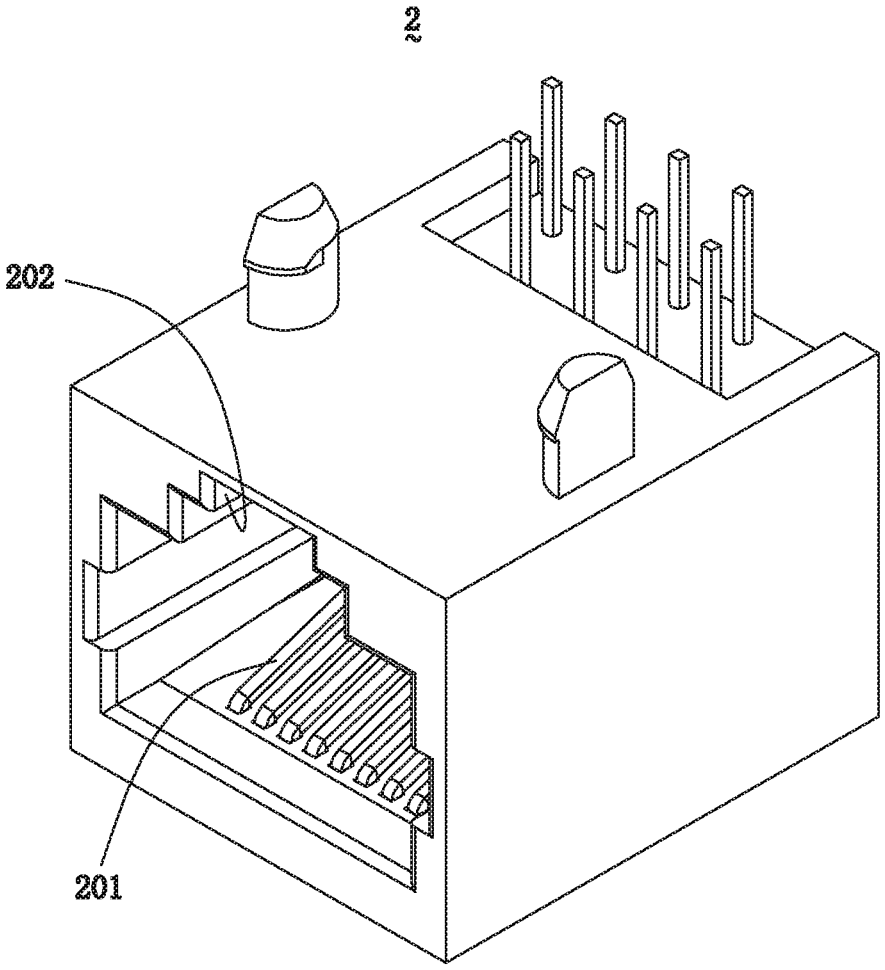
FIG. 18 is a schematic view of a socket connector.

Referring to FIG. 6, the signal transmission module 20 is mounted in the base 10, wherein the front portion 21 enters into the plug portion 12; the electrical contact terminals 23 are exposed to the outside from the bottom of the plug portion 12 for being ready to electrically contact with socket terminals 201 of a socket connector 2 as shown in FIG. 18; the rear portion 22 is placed into the receiving portion 11; and the cable 24 extends out of the base 10.

Referring to FIG. 4, the lock head 30 has a fixed end 31, a free end 32 and two symmetrical shoulders 33 formed between the fixed end 31 and the free end 32. The free end 32 forms two symmetrical edge protrusions 34 respectively located on two sides of the free end 32 and located on rear of the two shoulders 33. Each edge protrusion 34 has an upward inclined surface 340. In the embodiment, the upward inclined surface 340 is a front surface of the edge protrusion 34.

Referring to FIG. 6, the lock head 30 is fixed on the base 10. In detail, the fixed end 31 (seen in FIG. 4) is clamped between the base 10 and the signal transmission module 20. The free end 32 is located above the base 10 and extends backward. The two shoulders 33 are located above the base 10. The lock head 30 can go down under the action of an external force and automatically go up when the external force disappears.

Figure 7:
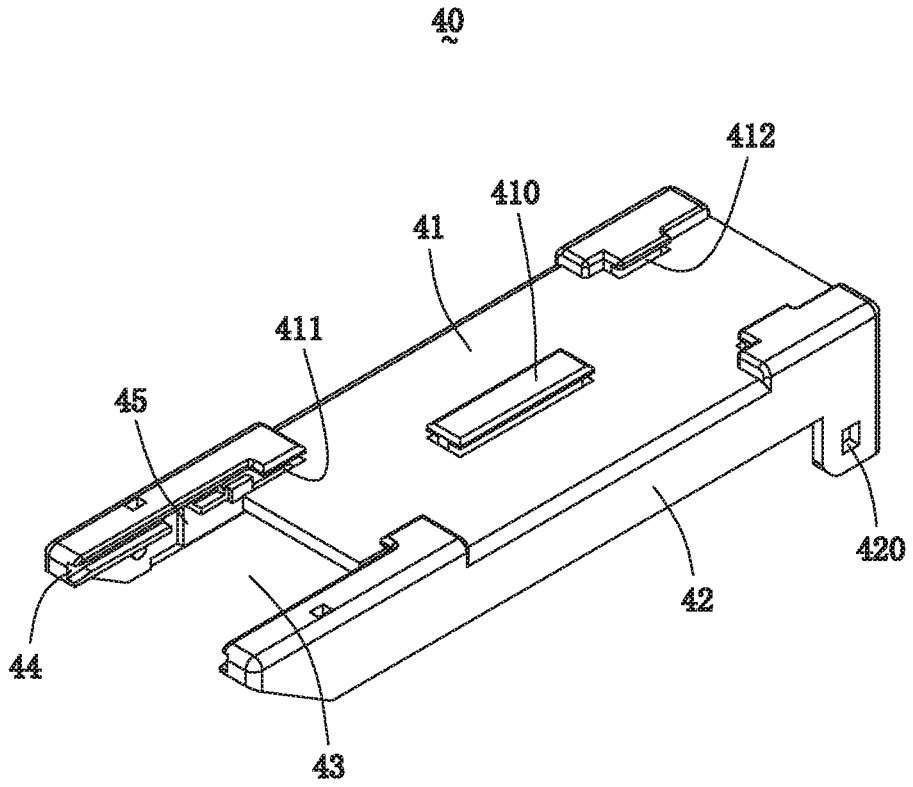
FIG. 7 is a schematic view of a cover of the present invention.
Figure 8:
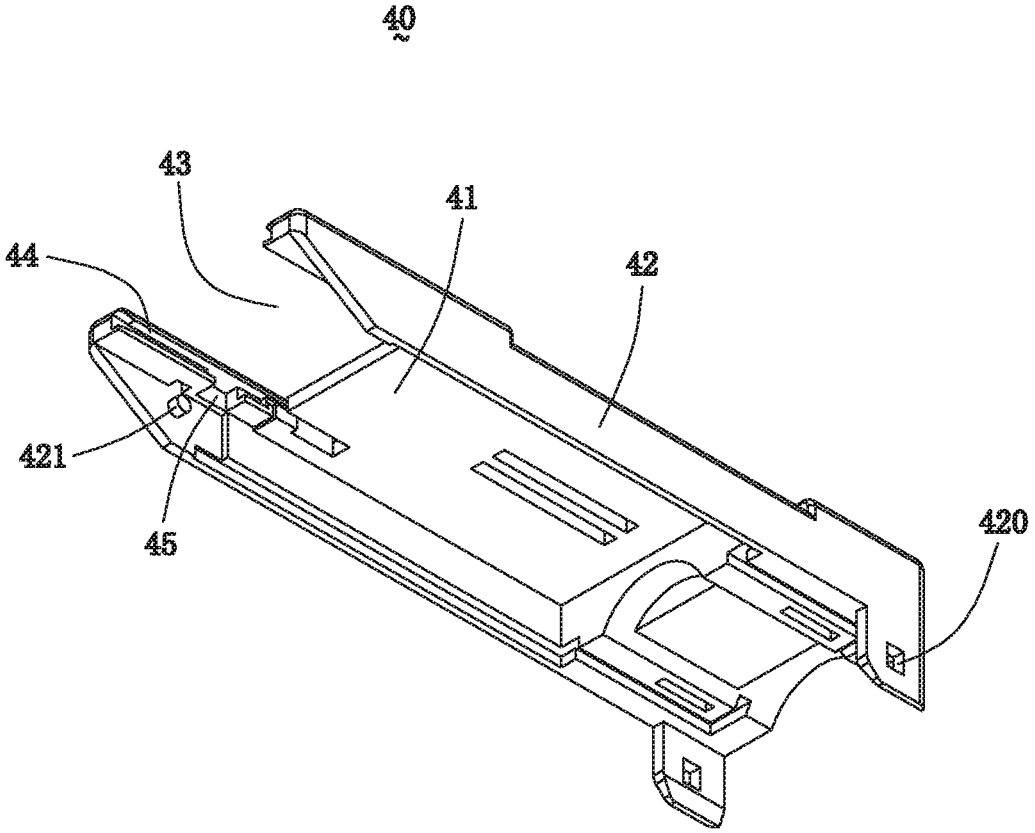
FIG. 8 is a schematic view of the cover of the present invention along another direction.
Figure 9:
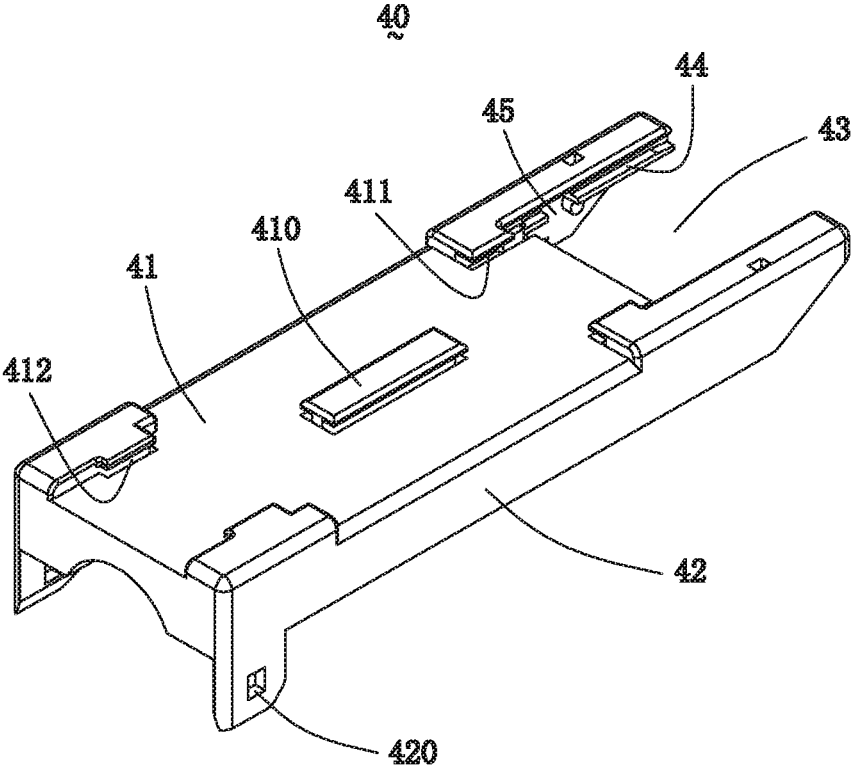
FIG. 9 is an another schematic view of the cover of the present invention.

Referring to FIGS. 7, 8 and 9, the cover 40 has a horizontal top wall 41, and two symmetrical sidewalls 42 perpendicular to the top wall 41. The top wall 41 has an opening 43 formed on a front end thereof, and two sliding grooves 44 formed on two sides of the opening 43. There forms a cut 45 on each sliding groove 44. The top wall further has a limiting bar 410 located on the middle of the top wall 41, two front limiting grooves 411 near the front end of the top wall 41, and two rear limiting grooves 412 near a rear end of the top wall 41. In the embodiment, each sidewall 42 forms a retaining hole 420 and a convex shaft 421 (seen in FIG. 8).

Figure 12:
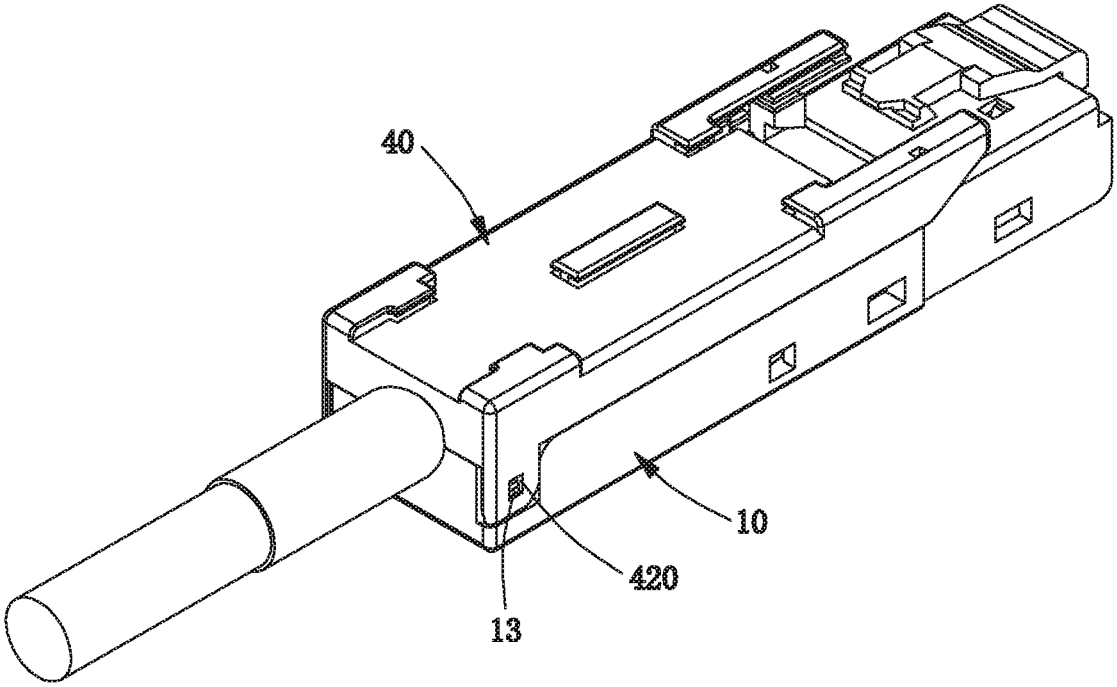
FIG. 12 is a schematic view of the cover, the signal transmission module and the base after being combined together in the present invention.

Referring to FIG. 12, the cover 40 is mounted on the base 10. The retaining hole 420 is combined with the corresponding bump 13, and the convex shaft 421 (seen in FIG. 8) is combined with the corresponding axis hole 14 (seen in FIG. 5), whereby the cover 40 is fixed on the base 10.

Figure 13:
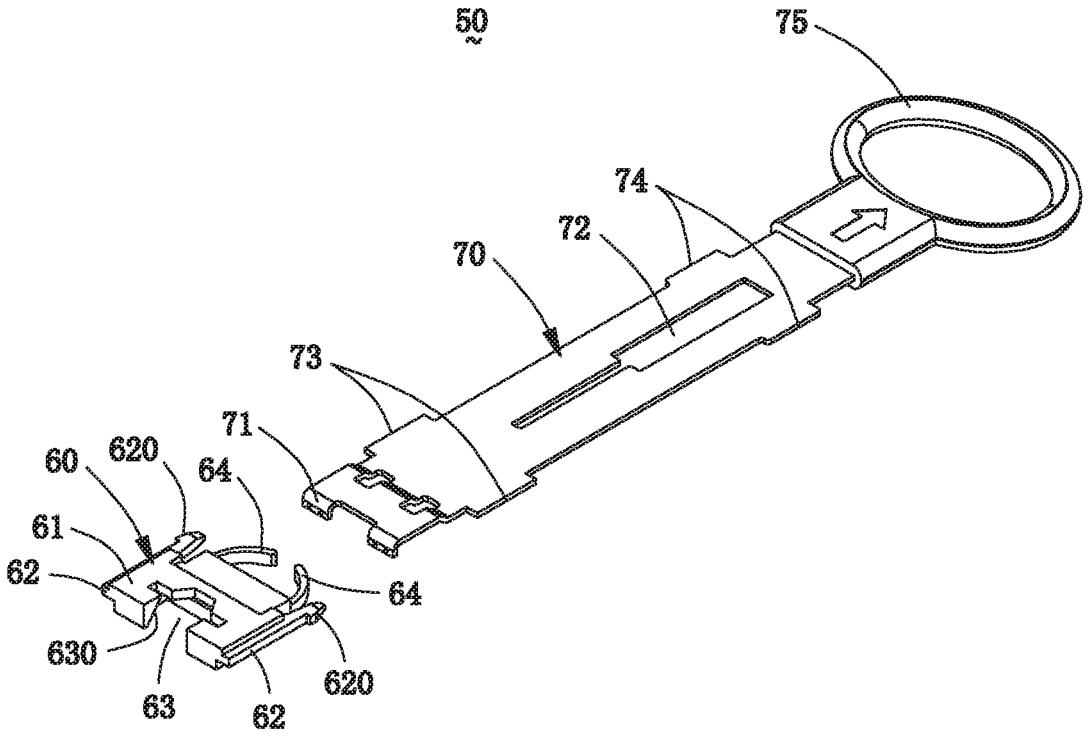
FIG. 13 is an exploded view of the unlocking device of the present invention.
Figure 14:
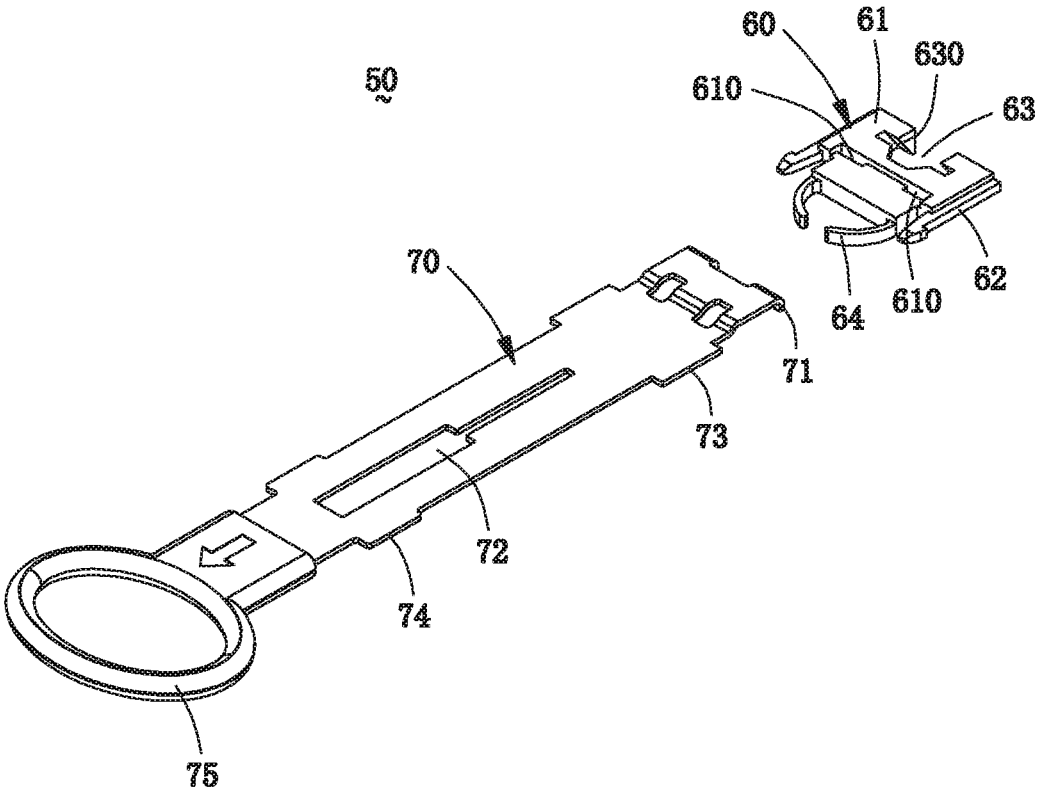
FIG. 14 is an exploded view of the unlocking device of the present invention along another direction.

Referring to FIGS. 13 and 14, the unlocking device 50 includes a sliding member 60 and a pull strip 70. The sliding member 60 is slidably mounted on the cover 40 and connected with the lock head 30. The pull strip 70 is connected with the sliding member 60.

Figure 15:
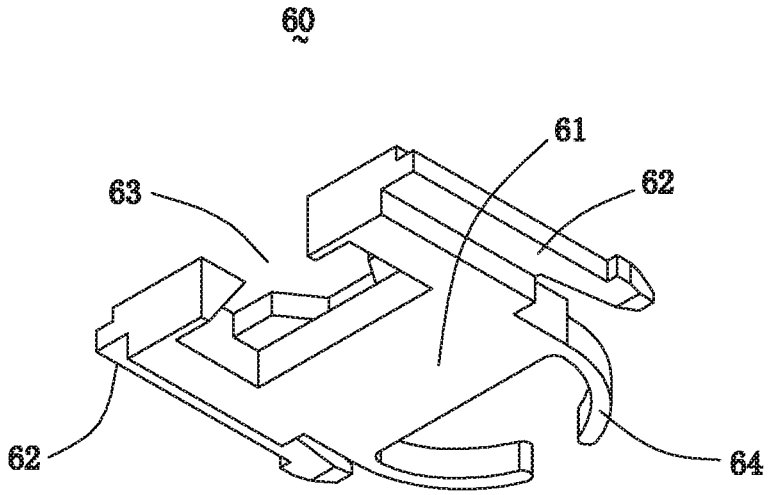
FIG. 15 is a schematic view of a sliding member of the present invention.

Referring to FIGS. 13, 14 and 15, the sliding member 60 has a flat plate-shaped main body 61, two sliding ribs 62 separately formed on two sides of the main body 61, a connection mouth 63 formed on the front of the main body 61, and an elastic arm 64 formed on the rear of the main body 61.

Referring to FIG. 14, the main body 61 has at least one slit 610, which is located on the top of the main body 61 and on rear of the connection mouth 63 for retaining the pull strip 70. In the embodiment, the main body 61 has two slits 610 on the top thereof.

Referring to FIG. 13, each sliding rib 62 has a hook 620 protruding outward on the rear of the sliding rib 62. In the embodiment, the rear of each sliding rib 62 is a free end. The free ends of two sliding ribs 62 expand slightly outward to provide an elastic fixing effect. The hook 620 is formed on the free end of the sliding rib 62.

Referring to FIGS. 13 and 15, a top contour of the connection mouth 63 is basically the same as a contour of the free end 32 of the lock head 30 (seen in FIG. 4). A bottom contour of the connection mouth 63 is different from the contour of the free end 32 of the lock dead 30. In the embodiment, the bottom contour of the connection mouth 63 is roughly square. The free end 32 of the lock head 30 can move in the connection mouth 63.

Referring to FIGS. 13 and 14, the connection mouth 63 has two downward inclined surfaces 630, which can be engaged with the upward inclined surfaces 340 of the edge protrusions 34. In the embodiment, the elastic arm 64 consists of two inward curved portions. In other embodiments, the elastic arm 64 can also adopt other structures.

Figure 16:
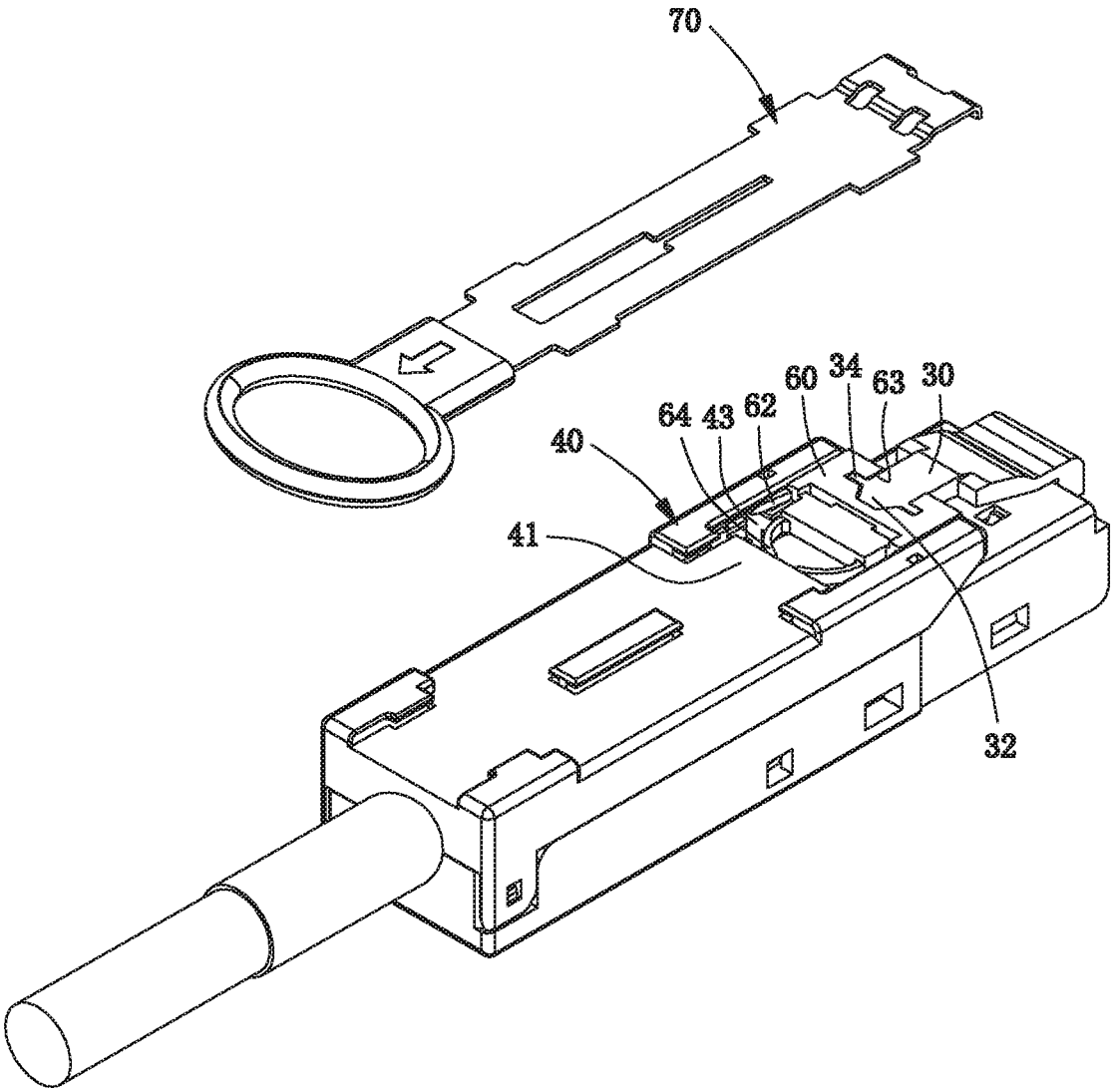
FIG. 16 is a schematic view of the plug connector of the present invention, in which the sliding member is mounted on the cover while a pull strip is not mounted.
Figure 17:
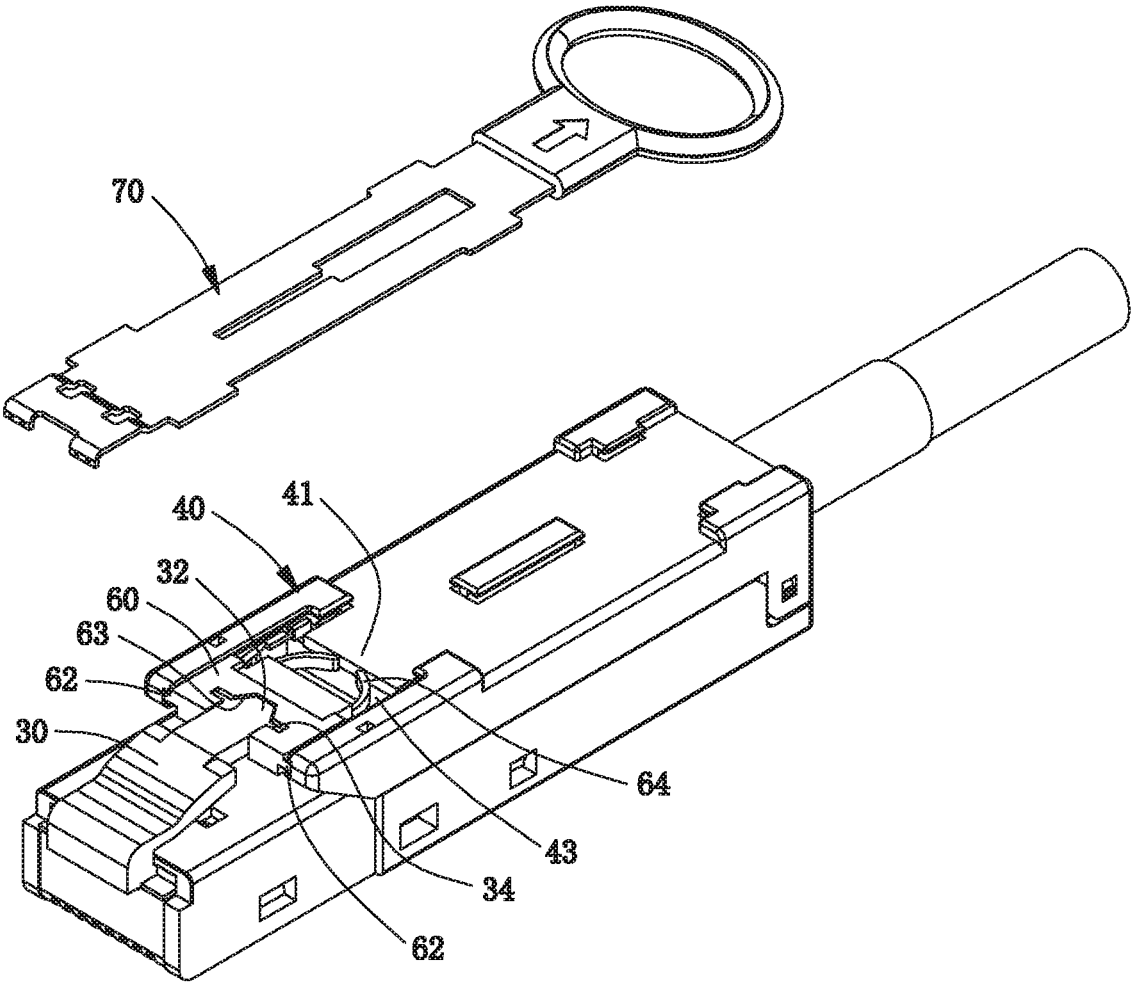
FIG. 17 is a schematic view of the plug connector of FIG. 16 along another direction.

Referring to FIGS. 16 and 17, the sliding member 60 is mounted in the opening 43 of the cover 40, and now the pull strip 70 is not mounted on the cover 40. The two sliding ribs 62 enter into the corresponding sliding grooves 44 (seen in FIG. 8), so the sliding member 60 can move forward and backward along the sliding grooves 44. The elastic arm 64 is pressed against the top wall 41 on the rear of the opening 43. The free end 32 of the lock head 30 is embedded into the connection mouth 63, and the top contours of the both coincides basically. Specifically, in an initial state, the upward inclined surfaces 340 (label seen in FIG. 4) of the edge protrusions 34 of the lock head 30 are pressed against the corresponding downward inclined surfaces 630 (seen in FIG. 13) of the connection mouth 63. When the sliding member 60 moves backward, the downward inclined surfaces 630 can push the edge protrusions 34 to move downward along the downward inclined surfaces 630 and further drive the lock head 30 to go down, thereby unlocking.

Figure 10:
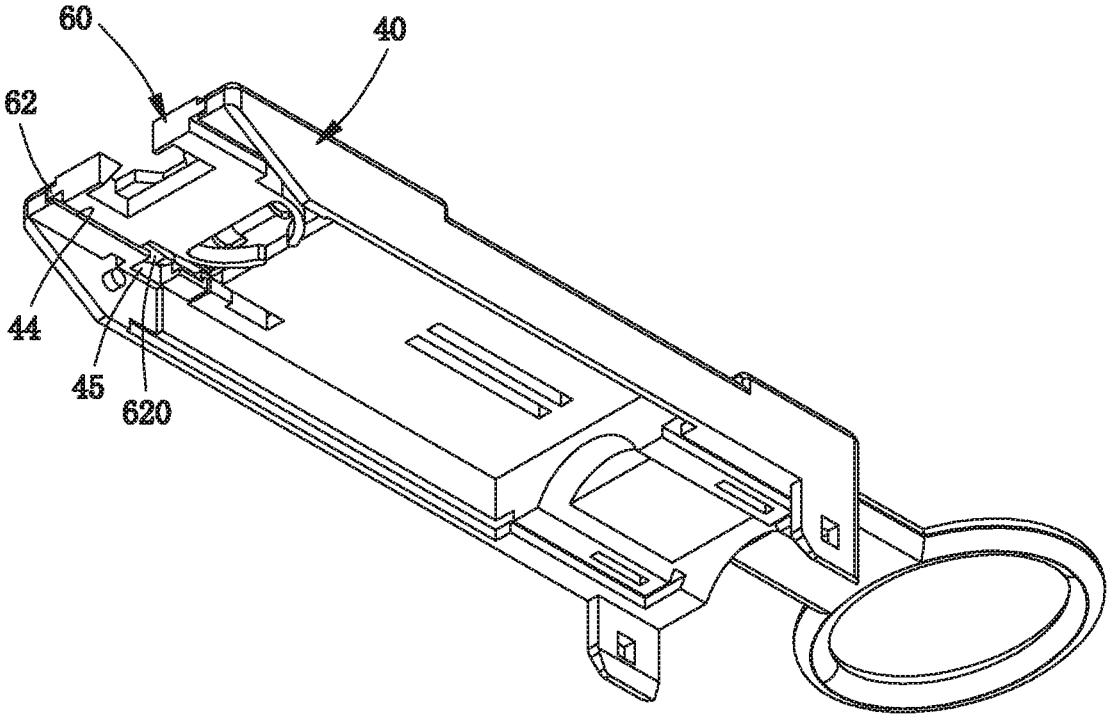
FIG. 10 is a schematic view of an unlocking device and the cover after being combined together in the present invention.
Figure 11:
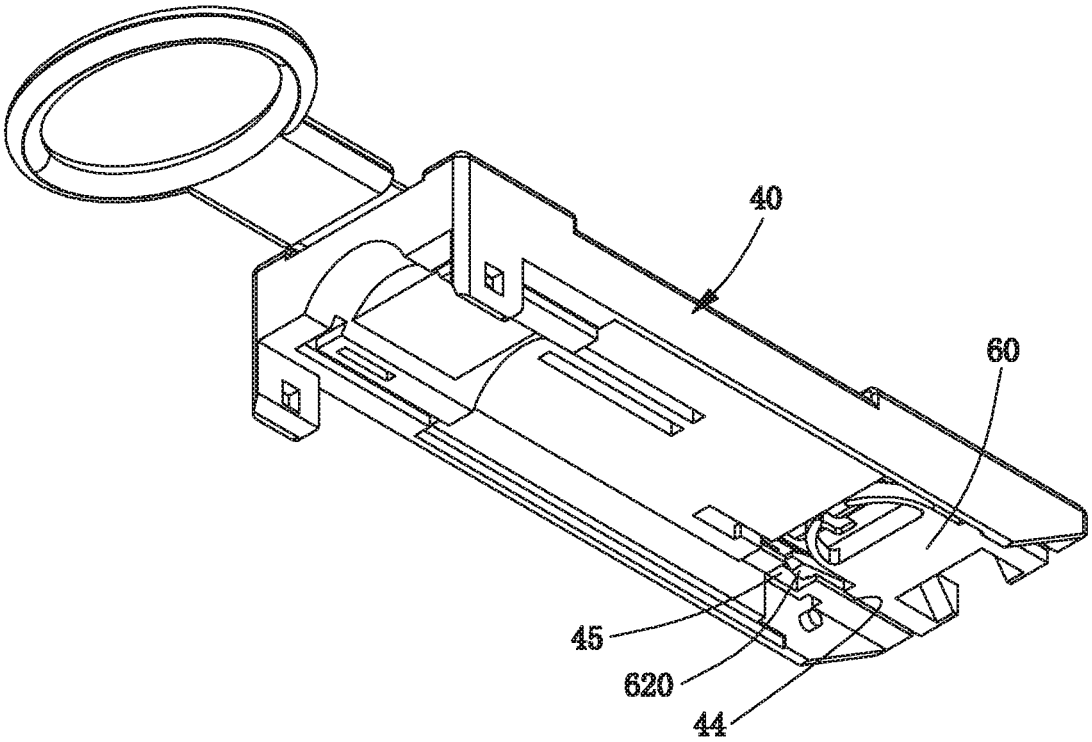
FIG. 11 is a schematic view of the unlocking device and the cover after being combined together in the present invention along another direction.

Moreover, referring to FIGS. 10 and 11, when the sliding member 60 is combined with the cover 40, the hook 620 of each sliding rib 62 enters into the cut 45 of the corresponding sliding groove 44 for controlling the moving distance of the sliding member 60. In detail, the length of the cut 45 is slightly greater than that of the hook 620, so the hook 620 can be allowed to slip properly within the cut 45. In the initial state, the hook 620 is pressed against a front surface of the cut 45. When the sliding member 60 is pulled backward, the hook 620 can move backward with the sliding member 60, and then the elastic arm 64 is compressed. When an external force is relieved, the elastic arm 64 restores its initial state, and the hook 620 can move forward and then be blocked by the front surface of the cut 45, thereby controlling the forward moving distance of the sliding member 60 and preventing excessive forward movement of the sliding member 60.

In the embodiment, the sliding member 60 is made of plastic. According to the test, if the elastic arm 64 of the sliding member 60 is compressed by 1.40 mm, the elastic arm 64 will be subjected to a positive force of 1.7N. A flexural strength of the plastic is 260 MPa, so the plastic can not be deformed.

Referring to FIGS. 13 and 14, the pull strip 70 has at least one claw 71 on a front end of the pull strip 70 to enter into the slit 610 of the sliding member 60 and connect the pull strip 70 and the sliding member 60 in a horizontal direction. In the embodiment, the claw 71 is a vertical sheet that bends vertically downward. In the embodiment, the pull strip 70 has two claws 71 on the front thereof.

Referring to FIGS. 13 and 14, the pull strip 70 further has a middle groove 72 in the middle of the pull strip 70, a pair of front side wings 73 near the front end of the pull strip 70, and a pair of rear side wings 74 near a rear end of the pull strip 70. In the embodiment, the pull strip 70 also has a pull ring 75 on the rear end thereof.

Figure 2:
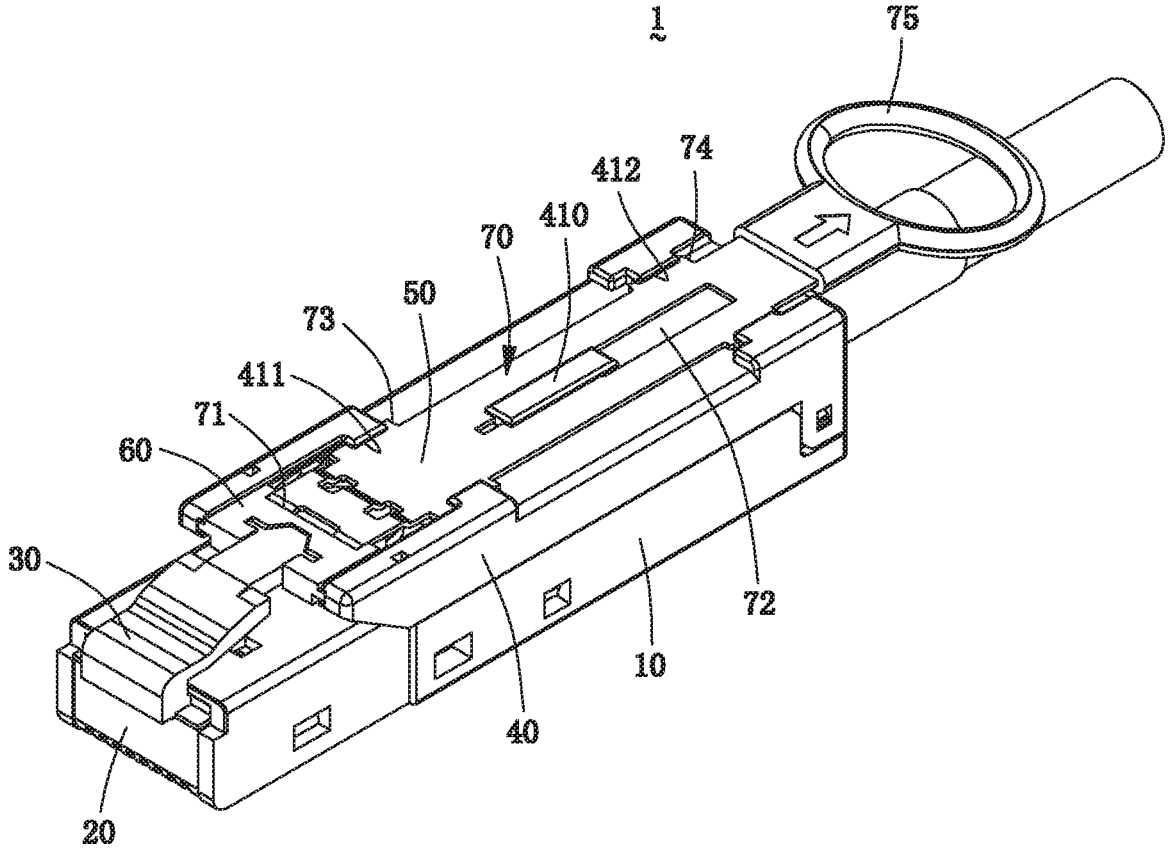
FIG. 2 is a perspective view of a plug connector of the present invention.
Figure 3:
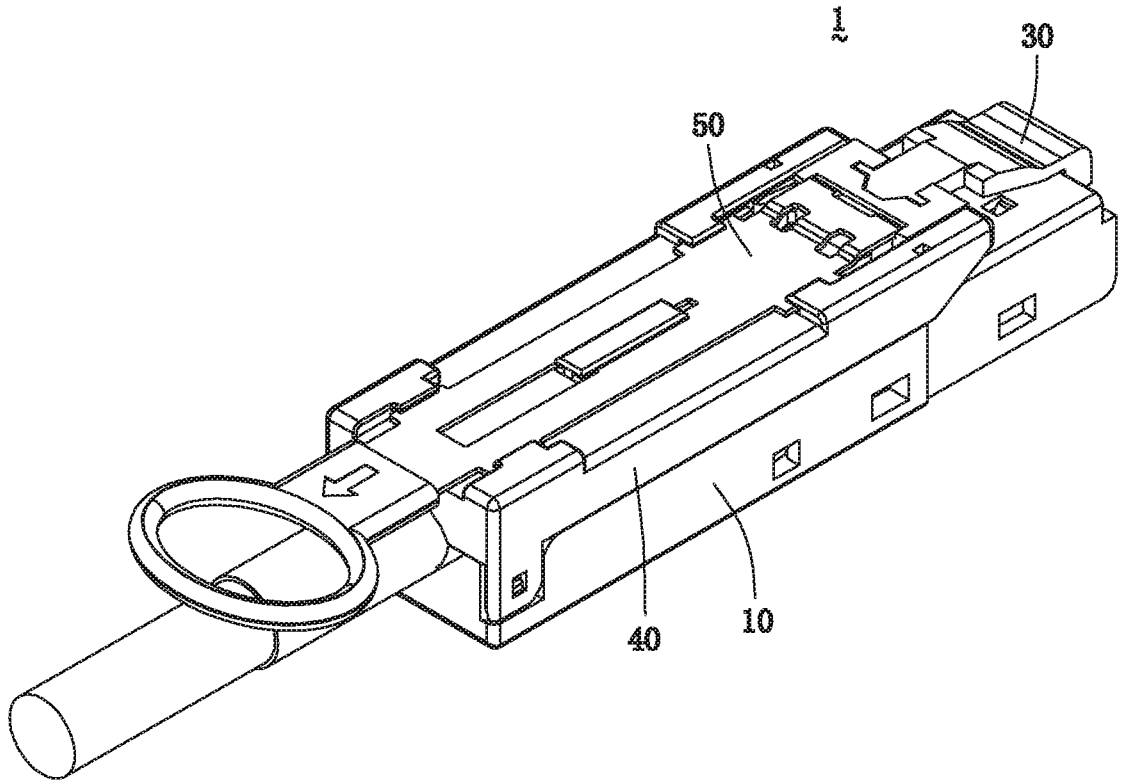
FIG. 3 is a perspective view of the plug connector of the present invention along another direction.

Referring to FIG. 2, the pull strip 70 is mounted on the top of the cover 40 and connected to the sliding member 60. Specifically, the claw 71 of the pull strip 70 is clipped into the slit 610 (seen in FIG. 14) of the sliding member 60. The front side wings 73 enter into the corresponding front limiting grooves 411, the rear side wings 74 enter into the corresponding rear limiting grooves 412, and the limiting bar 410 is protruding out of the middle groove 72. The pull ring 75 extends out of the cover 40 for being easily operated by users.

Figure 19:
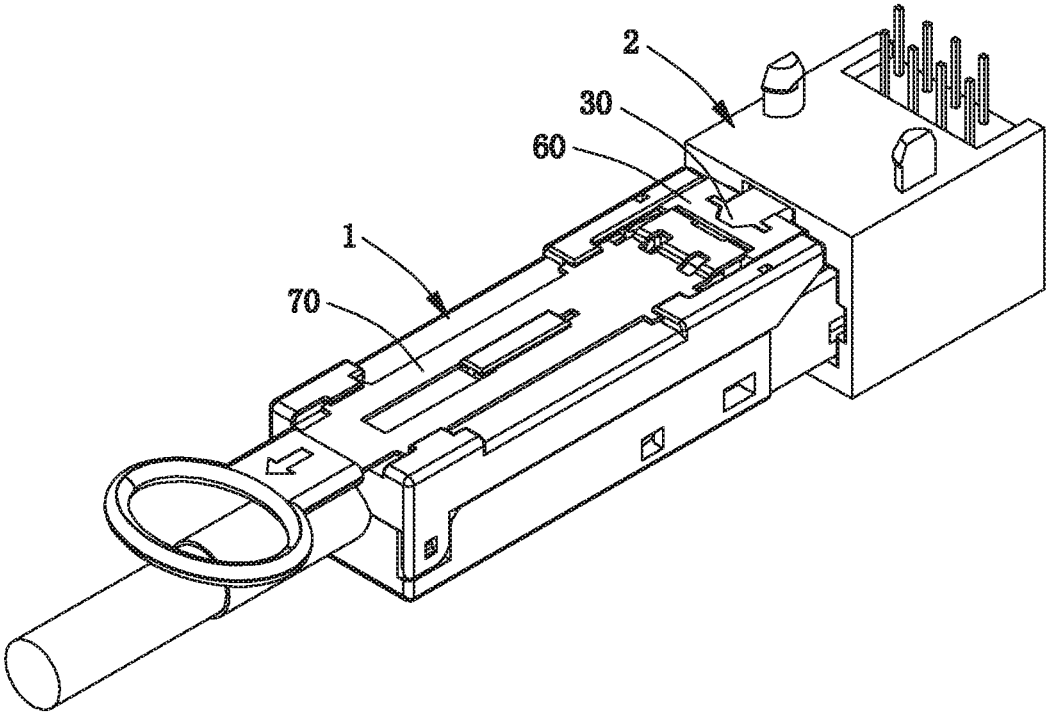
FIG. 19 is a schematic view after the plug connector is inserted into the socket connector.

Referring to FIG. 19, when pulling the pull strip 70 backward, the sliding member 60 can move backward and force the lock head 30 to go down, particularly force the two shoulders 33 (seen in FIG. 4) of the lock head 30 to go down, so that the plug connector 1 can be inserted into the socket connector 2 smoothly. When releasing the pull strip 70, the sliding member 60 can move forward and return to its initial state with the help of the elastic arm 64 (seen in FIG. 16), the lock head 30 is released and goes up to return to the initial state, so that the two shoulders 33 can be engaged with two blocks 202 (seen in FIG. 18) disposed inside the socket connector 2. Now, the plug connector 1 will not exit from the socket connector 2.

When needing to unlock, referring to FIG. 19, the pull strip 70 needs to be pulled backward, and the lock head 30 is forced to go down, the two shoulders 33 will not be blocked by the blocks 202 (seen in FIG. 18) of the socket connector 2 and can go backward, so that the plug connector 1 can be pulled out smoothly.

As described above, the plug connector 1 having unlocking function in the present invention can make the sliding member 60 move backward by the pull strip 70, and force the lock head 30 to go down, thereby realizing to unlock. Moreover, when releasing the pull strip 70, the lock head 30 can go up with the help of the sliding member 60, thereby realizing locking. Therefore, the locking and unlocking way of the present invention is safe, effective and convenient.

What is claimed is:

1. A plug connector having unlocking function, comprising:

a base;

a signal transmission module being mounted in the base;

a lock head being disposed on the base; the lock head having a fixed end fixed on the base, a free end located above the base and extending backward, and two shoulders formed between the fixed end and the free end; the two shoulders being located above the base and being capable of being locked in a socket connector; wherein the free end forms two symmetrical edge protrusions, each of which has an upward inclined surface;

a cover being mounted on the base and having a horizontal top wall and two symmetrical sidewalls perpendicular to the top wall; wherein the cover forms two sliding grooves, each of which has a cut; and an unlocking device including a sliding member and a pull strip; the sliding member being slidably mounted on the cover and being connected with the lock head; and the pull strip being connected with the sliding member;

wherein the sliding member has a main body, two sliding ribs separately formed on two sides of the main body, a connection mouth formed on a front of the main body, and an elastic arm formed on a rear of the main body; each sliding rib having a hook protruding outward on a rear of the sliding rib; the connection mouth having two downward inclined surfaces, which can be engaged with the corresponding upward inclined surfaces of the edge protrusions; wherein the sliding rib enters into the corresponding sliding groove, the hook entering into the corresponding cut, the elastic arm being pressed against the top wall of the cover, the free end of the lock head being embedded into the connection mouth, and the upward inclined surface of the edge protrusion being pressed against the corresponding downward inclined surface;

when pulling the pull strip backward, the sliding member can move backward, the elastic arm can be compressed, the downward inclined surface can push the corresponding edge protrusion to move downward and further drive the lock head to go down for unlocking; when releasing the pull strip, the sliding member can automatically move forward with the help of the elastic arm, and the lock head can go up to return to its initial state.

2. The plug connector having unlocking function as claimed in claim 1, wherein the top wall of the cover has an opening formed on a front end thereof, the two sliding grooves are formed on two sides of the opening, and the sliding member is mounted in the opening of the cover.

3. The plug connector having unlocking function as claimed in claim 1, wherein the elastic arm consists of two inward curved portions.

4. The plug connector having unlocking function as claimed in claim 1, wherein the main body of the sliding member has at least one slit formed on a top of the main body and located on rear of the connection mouth; and the pull strip has at least one claw on a front end of the pull strip, and the claw enters into the slit.

5. The plug connector having unlocking function as claimed in claim 4, wherein the top wall of the cover has a limiting bar located on a middle of the top wall, two front limiting grooves near a front end of the top wall, and two rear limiting grooves near a rear end of the top wall; and the pull strip has a middle groove in a middle of the pull strip, a pair of front side wings near the front end of the pull strip, and a pair of rear side wings near a rear end of the pull strip;

wherein the front side wings enter into the corresponding front limiting grooves, the rear side wings enter into the corresponding rear limiting grooves, and the limiting bar is protruding out of the middle groove.

6. The plug connector having unlocking function as claimed in claim 4, wherein the pull strip has a pull ring on a rear end of the pull strip.

7. The plug connector having unlocking function as claimed in claim 1, wherein the two edge protrusions are symmetrically formed on two sides of the free end; the two shoulders are also symmetrically located on two sides of the free end; and the upward inclined surface is a front surface of the edge protrusion.

8. The plug connector having unlocking function as claimed in claim 1, wherein a top contour of the connection mouth is the same as a contour of the free end of the lock head.

9. The plug connector having unlocking function as claimed in claim 1, wherein the base has a U-shaped receiving portion, and an inverted U-shaped plug portion communicated with the receiving portion.

10. The plug connector having unlocking function as claimed in claim 9, wherein the signal transmission module has a front portion, a rear portion, multiple electrical contact terminals located at the front portion and exposed on a bottom of the front portion, and a cable extending out of the rear portion; wherein the front portion enters into the plug portion; the electrical contact terminals are exposed to the outside from a bottom of the plug portion; the rear portion is placed into the receiving portion; and the cable extends out of the base.

* * * * *